US005736699A

United States Patent [19]

Furlan et al.

[11] Patent Number: 5,736,699

[45] Date of Patent: Apr. 7, 1998

[54] ELECRO-MECHANICAL PROGRAMMER/ TIMER

[75] Inventors: Michael R. Furlan, Des Plaines; George D. Georgacakis, Stokie; Norman A. Schutzkus, S. Elgin, all of Ill.

[73] Assignee: Eaton Corporation, Cleveland, Ohio

[21] Appl. No.: 642,366

[22] Filed: May 3, 1996

[51] Int. Cl.[6] ..... H01H 43/10

[52] U.S. Cl. ..... 200/38 R; 200/38 B; 200/38 C

[58] Field of Search ..... 200/33 R–40

[56] References Cited

U.S. PATENT DOCUMENTS

| | | | |
|---|---|---|---|
| Re. 29,158 | 3/1977 | Cartier et al. | 200/38 B |
| 3,819,886 | 6/1974 | Homan et al. | 200/38 B |
| 4,551,590 | 11/1985 | Mahon | 200/38 R |
| 4,577,179 | 3/1986 | Chambers et al. | 200/38 R X |
| 4,599,499 | 7/1986 | Duve | 200/38 R |
| 4,611,103 | 9/1986 | Eder et al. | 200/38 B |
| 4,616,209 | 10/1986 | Mahon | 200/35 R X |
| 4,629,845 | 12/1986 | Mahon | 200/35 R X |
| 4,755,635 | 7/1988 | Willigman | 200/35 R |
| 5,042,311 | 8/1991 | Duve et al. | 200/38 B X |

*Primary Examiner*—J. R. Scott
*Attorney, Agent, or Firm*—Roger A. Johnston

[57] ABSTRACT

The present invention provides an electro-mechanical programmer/timer having a plurality of switches actuated by a rotating program cam with each of the switches tracking a separate cam track on the cam. The program cam is indexed by a pawl which engages ratchet teeth on the program cam. The pawl is oscillated by engagement with a sub-interval cam driven by a motor drive. At least one of the switches following the program cam is a single-pole double-throw switch with the center blade thereof actuated by a cam follower lever operated by a separate track on the sub-interval cam.

8 Claims, 5 Drawing Sheets

ELECRO-MECHANICAL PROGRAMMER/ TIMER

BACKGROUND OF THE INVENTION

The present invention relates to electro-mechanical programmers or timers as they are sometimes referred to of the type which utilize a rotary cam advanced through a program cycle by a motorized advance mechanism for sequentially activating and deactivating a plurality of electrical switches utilized for controlling program functions of the apparatus or appliance to be controlled. Such electro-mechanical programmer/timers are commonly employed for controlling the program cycle in household appliances such as washing machines, dishwashers and clothes driers. In such household appliances, it is common practice for the user to set the initial rotary position of the program cam for the desired portion of the program cycle and, initiate the machine operation. Thereafter the motorized advance mechanism indexes the program cam to complete the program cycle of the appliance to be controlled.

Heretofore, it has been known to provide an electro-mechanical appliance programmer/timer having the program cam indexed by an oscillating advance pawl driven by a sub-interval or drive cam with the pawl contacting ratchet teeth provided on the program cam. The sub-interval or drive cam completes a full cycle of its operation during a time interval which represents a small fraction of the time interval required for the complete program cycle. Such electro-mechanical programmer/timers typically utilize a plurality of cam tracks on the program cam for controlling the actuation of individual switches each having a cam follower contacting one of the tracks. This latter type of programmer/timer provides the sequential making and breaking of a pair of electrical contact blades following the individual cam track.

For timing accuracy in such arrangements it is known to have one of a pair of switch contact blades following the base circle of the cam and the other blade of the pair to respond to the lifting surfaces of the cam track. This arrangement has enabled the required accuracy in the sequential actuation of the switch formed by the contact pair; however, this type of switching has been restricted by the limits of cam track accuracy within the limited circumference of the cam available in the allotted space for the programmer/timer. Where it has been desired to provide a more complex switching function such as, for example, a single-pole double-throw switching function and/or to provide additional switching functions at sub-intervals of the appliance program cycle, it has proven extremely difficult to provide such functions within the size and cost constraints allotted for programmer/timers in the presently highly competitive appliance marketplace.

SUMMARY OF THE INVENTION

It is an object of the present invention to provide an electro-mechanical programmer/timer providing a complex secondary sub-interval switching function in a manner that is low in cost and simple in construction.

It is a further object of the present invention to provide an electro-mechanical programmer/timer having a single-pole double-throw switching function which is operated at a sub-interval of the main program cam cycle interval.

The electro-mechanical programmer/timer of the present invention has a single-pole double-throw switch having at least one side contact thereof operated by a follower registering on a cam track of the main program cam. The center contact of the single-pole double-throw switch is moved to a predetermined position by a cam follower actuated by a sub-interval cam; and, the sub-interval cam is preferably operative to provide a make and break function of the center contact blade with respect to at least one of the side contact blades during the sub-interval operation.

DETAILED DESCRIPTION

Figure 1:
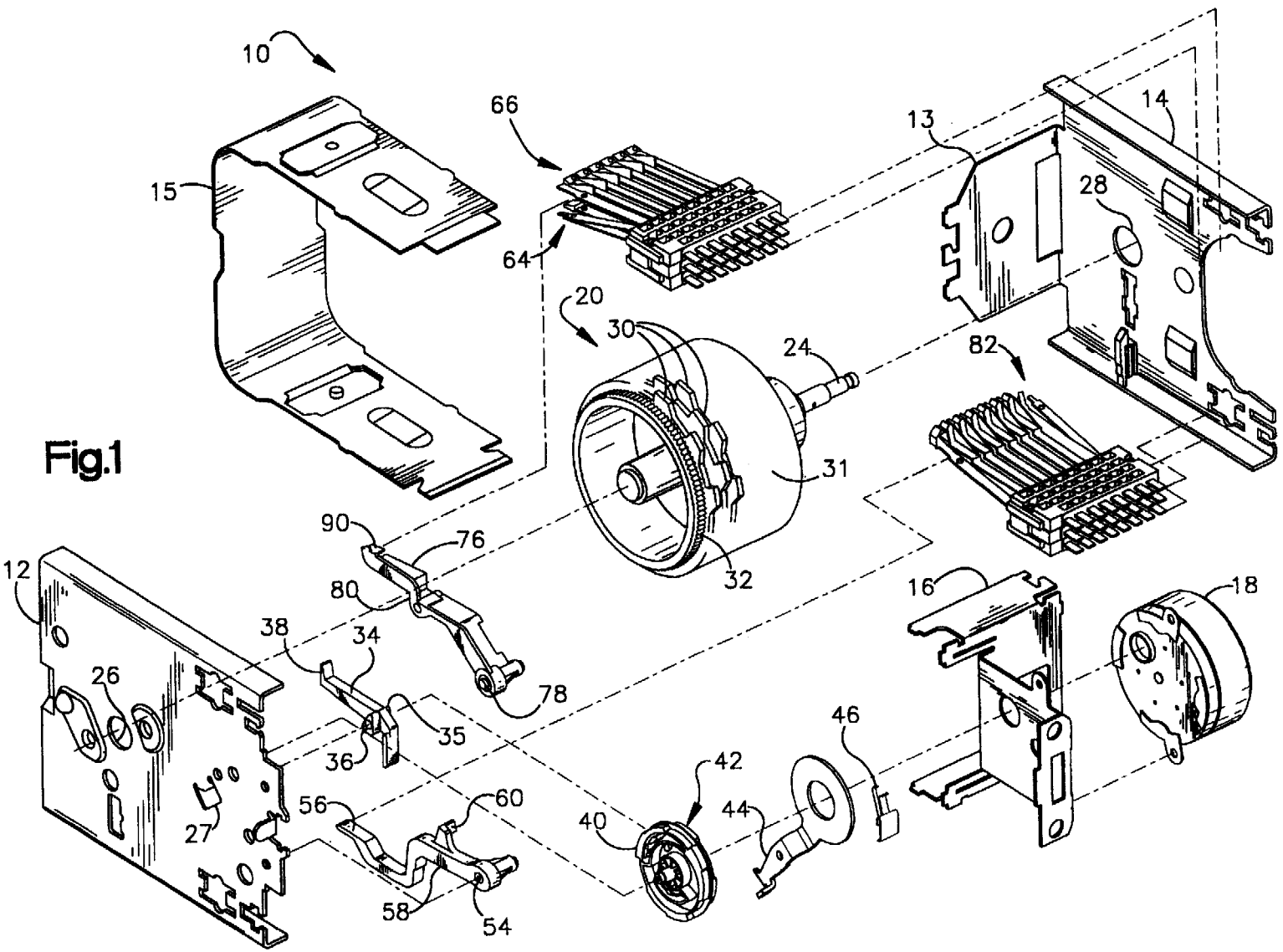
FIG. 1 is an exploded view of the programmer/timer of the present invention.
Figure 5:
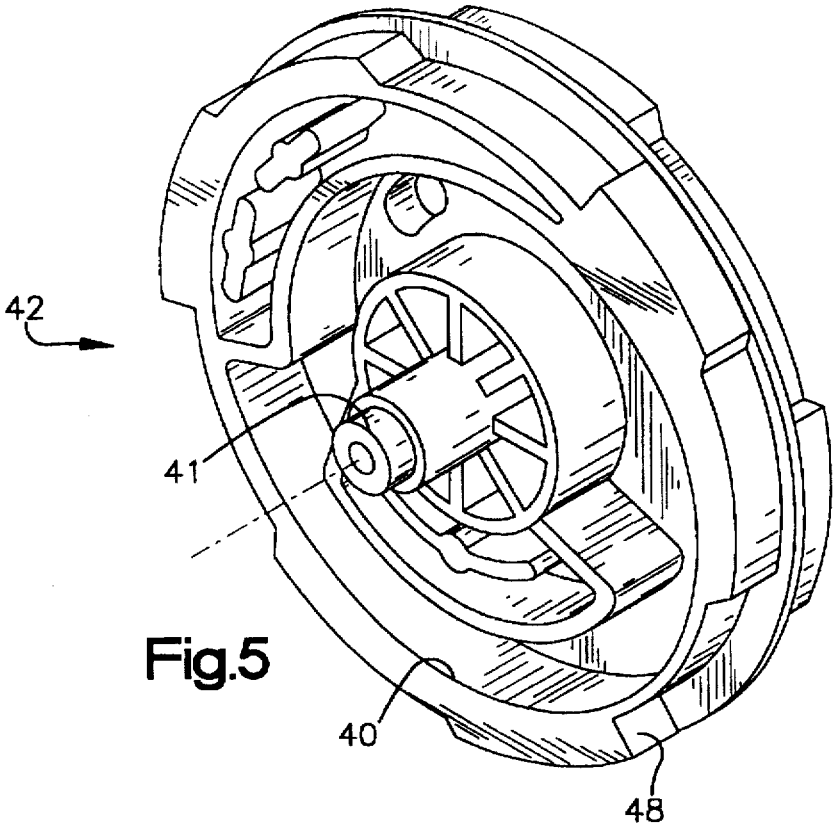
FIG. 5 is an axonometric view of the advance pawl side of the drive cam of FIG. 1; and, FIG. 6 is an axonometric view of the reverse side of the drive cam of FIG. 1.
Figure 6:
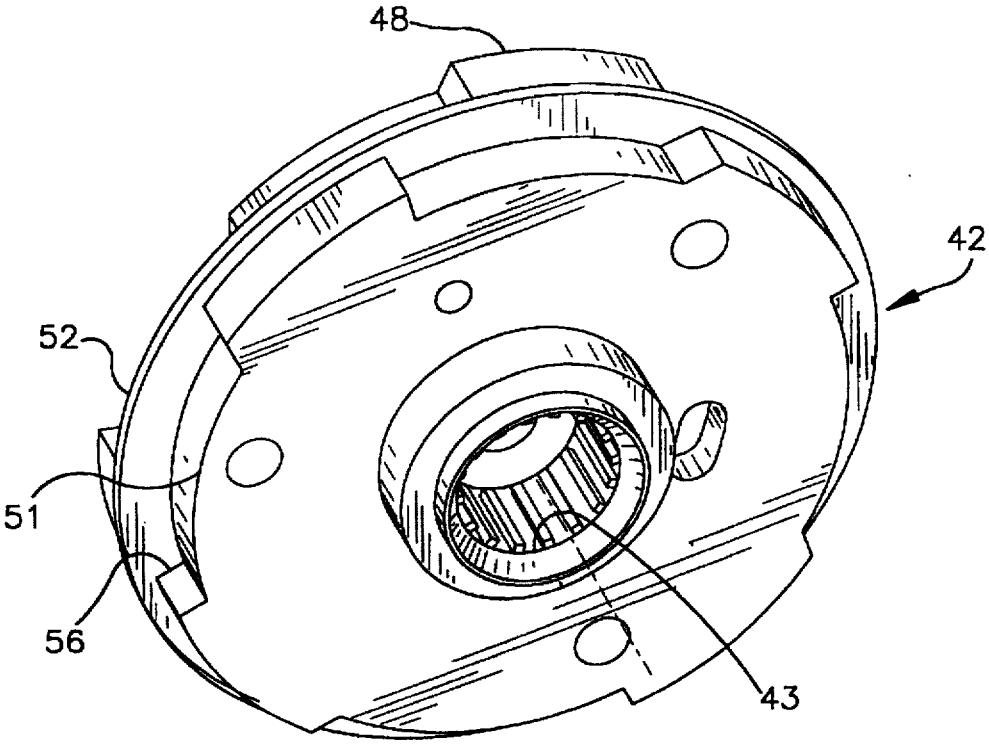

Referring FIGS. 1, 5 and 6, the electro-mechanical programmer/timer of the present invention is indicated in exploded view generally at 10 and includes a pair of spaced side plates 12, 14 which, when assembled, along with a motor mounting plate 16 provide a base or frame for the programmer/timer 10. A suitable timing motor 18 is mounted on the frame 16 and provides the motive power for a cam advance function within the assembly 10. If desired, a dust cover 15 is provided.

A main program cam indicated generally at 20 has a central hub with the opposite ends thereof denoted by reference numerals 22, 24 respectively journalled in suitable apertures provided in the plates 12, 14 as denoted by reference numerals 26, 28. Program cam 20 has a base circle diameter 31 which includes a plurality of program cam tracks denoted by reference numeral 30 provided circumferentially thereabout in axially spaced arrangement. Program cam 20 also has a ring of ratchet teeth denoted by reference numeral 32 provided about the periphery thereof at one axial face.

A drive pawl 34 has a projection or trunnion 36 provided thereon which pivotally engages an aperture 27 in plate 12; and, pawl 34 also has a chisel tooth 38 on one end thereof which engages ratchet teeth 32. The pin 35 of pawl 34 engages a cam track 40 formed in one axial face of a sub-interval or drive cam indicated generally at 42 which is driven by motor 18 for effecting oscillation of pawl 34 and indexing of cam 20. If desired, an anti-reverse pawl 44 may be provided for engaging ratchet teeth 32 under the urging of a pawl spring 46.

Referring to FIGS. 5 and 6, the sub-interval or drive cam 42 is shown as having a pair of axially spaced peripheral cam tracks 48, 50 provided thereabout on opposite sides of an annular flange 52. The drive cam 42 has a hub 41 on the drive cam side which is journalled in an aperture in plate 12, cam 42 has a spline 43 provided in the hub on the opposite face, which engages a correspondingly splined output shaft (not shown) on motor 18.

Figure 2:
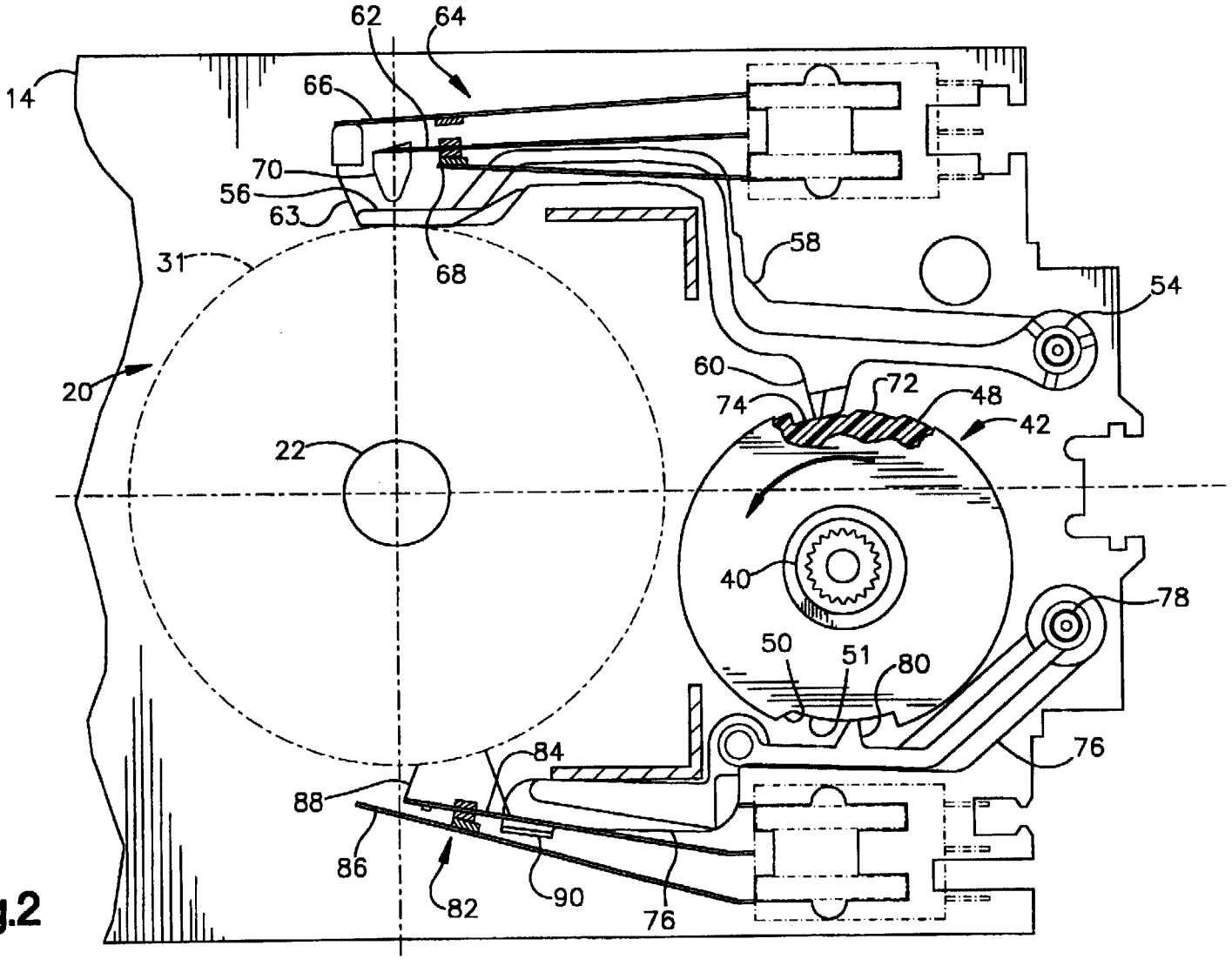
FIG. 2 is a plan side view of the assembled embodiment of FIG. 1, with one base plate omitted.
Figure 3:
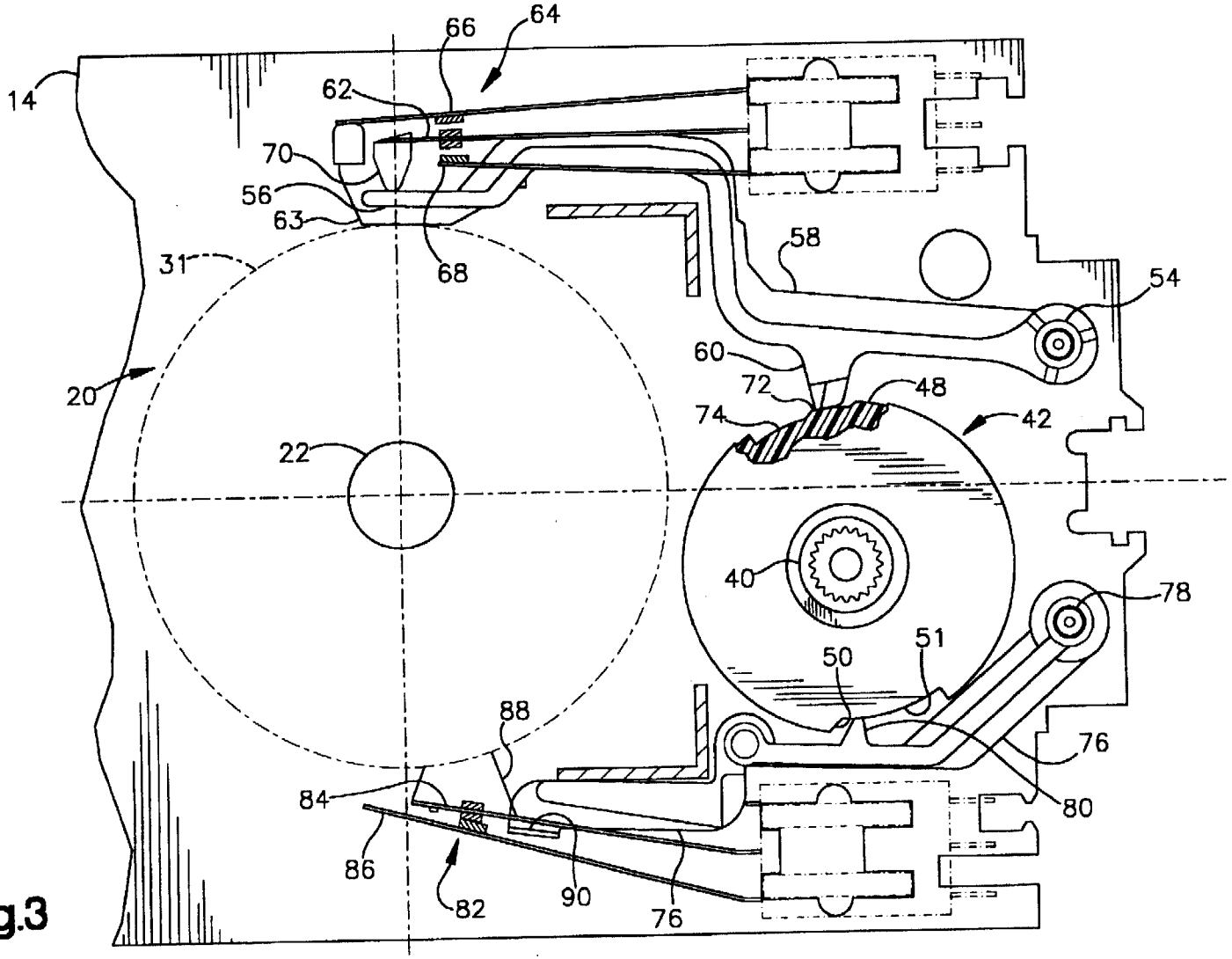
FIG. 3 is a view similar to FIG. 2.
Figure 4:
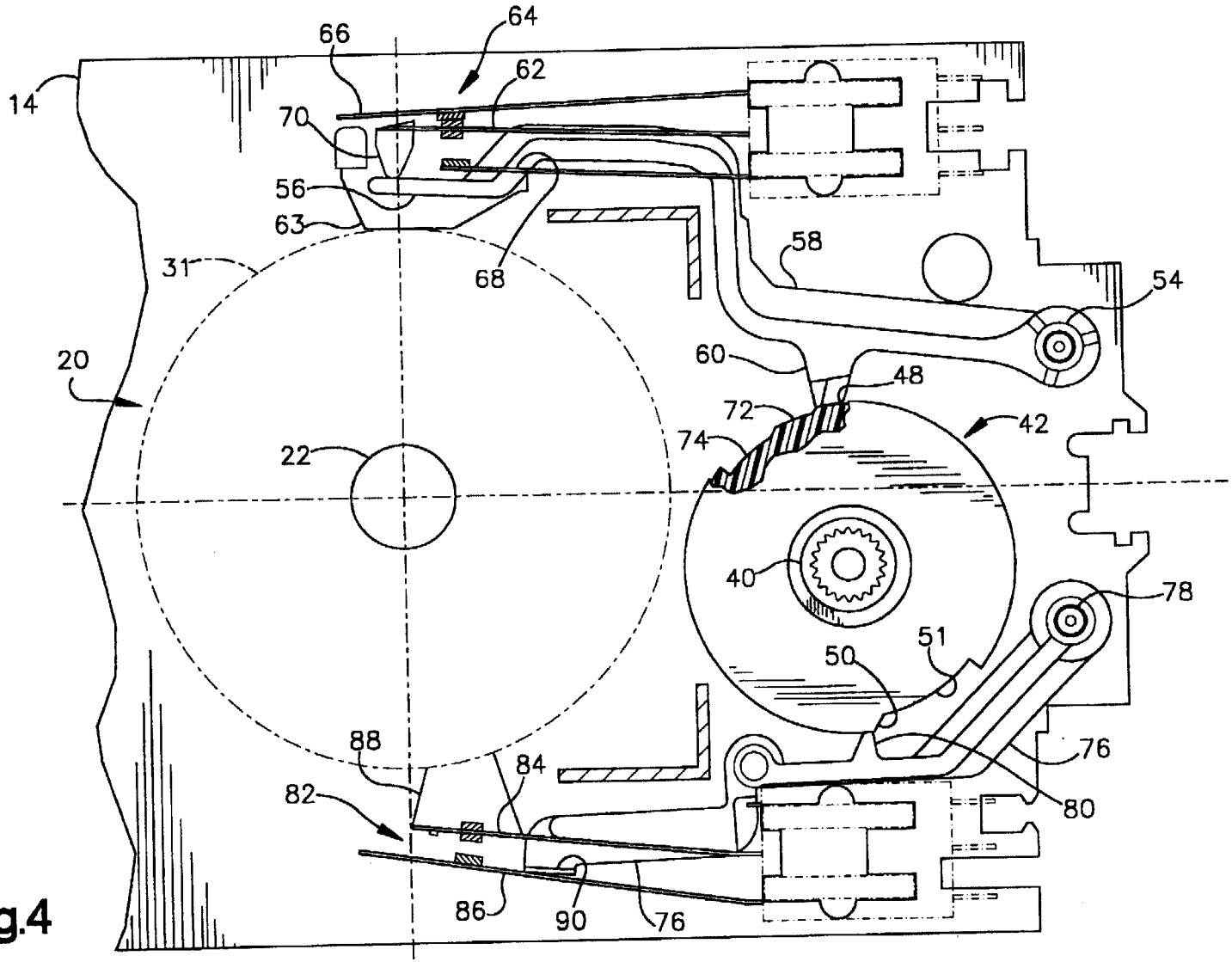
FIG. 4 is a view similar to FIG. 2.

Referring to FIGS. 1 through 4, a sub-interval cam follower lever 58 has a projection or trunnion 54 provided thereon which pivotally engages an aperture in the frame plate 12; and, follower lever 58 has a follower 60 provided thereon which engages peripheral cam track 48 of sub-interval cam 42. Follower 58 has an end 56 thereof, remote from trunnion 54, disposed for engaging and moving the center blade contact 62 of a switch, indicated generally at 64 which is one of a plurality of switches indicated generally at 66 assembled in a cluster and disposed between the plates 12, 14. A certain one of the switches 64 which comprises a single-pole double-throw switch is illustrated in FIGS. 2, 3 and 4. Switch 64 has an upper blade contact 66 and a lower blade contact 68 disposed on opposite sides of the center blade contact 62. The center blade contact 62 has a follower lug or projection 70 extending downwardly from the end thereof for being contacted by the end 56 of the follower arm 58.

If desired, the sub-interval cam 42 may have cam track 48 formed with an intermediate level 72 for holding the center blade contact 62 in a neutral position as shown in FIG. 3. It will be understood when sub-interval cam 42 is rotated in an anti-clockwise direction for the FIG. 2 position to position track 48 as shown in FIG. 3, the follower portion 60 is in contact with the base circle 74 of cam track 48; and, in this position center blade contact 62 has dropped from the neutral position of FIG. 2 to a position closing against lower blade contact 68 as shown in FIG. 2. Thus, the sub-interval cam track 48 may be configured to provide various combinations of positions of switch 64 depending upon the configuration of cam track 48.

Referring to FIG. 4, switch 64 has been further rotated in an anti-clockwise direction from the FIG. 3 position to a position in which the center contact blade is raised to close against upper blade contact 66 and to break from lower blade contact 68.

Referring to FIGS. 1 through 4, an auxiliary sub-interval cam follower lever 76 has a projection or trunnion 78 formed on one end thereof which is journalled in an aperture provided in plate 12. Lever 76 has a cam follower portion 80 provided thereon which is registered upon cam track 50 of sub-interval cam 42 with the base circle of track 50 indicated by reference numeral 51.

An auxiliary set of switches indicated generally at 82 is mounted between the frame plates 12, 14; and, one of the switches is indicated generally at 82 in FIGS. 2, 3 and 4. Switch 82 includes a first and second blade contact 86, 84 with the blade 86 having a follower 88 thereon which registers on base circle 31 of the program cam 20. Follower lever 76 has an end portion 90 thereof engaging one of the blade contacts 86, 84 for effecting making and breaking thereof in response to cam track 50 on the sub-interval cam 42. It will be understood that the switch 82 functions as a single-pole single-throw switch.

The present invention thus provides a simple and inexpensive to manufacture design for an electro-mechanical programmer/timer having a plurality of switches operated by a rotating cam and having at least one of the plurality of switches comprising a single-pole double-throw switch having the center blade thereof operated by a cam follower arm tracking a separate cam on the sub-interval or drive cam for indexing the main program cam.

Although the present invention has hereinabove been described with respect to the illustrated embodiments, it will be understood that the invention is capable of modification and variation and is limited only by the following claims.

We claim:

1. An electro-mechanical programmer/timer comprising:

(a) base or frame means having motor means thereon;

(b) program cam means mounted on said base means for rotary timed advancement through a program cycle;

(c) advance means connected to said motor means and operative to effect timed advancement of said program cam means;

(d) sub-interval cam means connected to said motor means and operatively advanced through a full cycle in a sub-interval or fraction of the cycle interval of said program cam;

(e) a single pole double-throw switch having a first side contact blade thereof having a cam follower responsive to said program cam, a center contact blade and a second side contact blade having cam follower responsive to said program cam; and, (f) a sub-interval cam follower contacting said sub-interval cam means and operative to move said center contact blade to a predetermined position for a predetermined sub-interval period.

2. The programmer/timer defined in claim 1, wherein said program cam is operative during said sub-interval period to move said center contact blade to selectively make and break against said first and second side contact blades.

3. The programmer/timer defined in claim 1, further comprising a second switch having a first and second contact blade, said first blade including a follower contacting said program cam means; and, an auxiliary sub-interval follower contacting said sub-interval cam means and operative to move said second switch second contact blade to a predetermined position during said sub-interval period.

4. The programmer/timer defined in claim 3, wherein said sub-interval cam is operative to move said second switch second contact blade between a position making and a position breaking a circuit with said second switch first contact blade.

5. The programmer/timer defined in claim 3, wherein said sub-interval cam means includes a first cam track operating said sub-interval follower and a second cam track operating said auxiliary sub-interval follower.

6. A method of electro-mechanical programming electrical switching as a function of time comprising:

(a) providing a motorized timed advance mechanism;

(b) advancing a program cam through a cycle with said mechanism in a predetermined interval of time;

(c) providing a sub-interval cam and advancing said sub-interval cam through a cycle with said advance mechanism for a predetermined fraction of said interval.

(d) providing a single-pole double-throw switch having a center contact blade and a pair of oppositely disposed side contact blades and cycling the center contact blade thereof with said sub-interval cam and making and breaking said center contact blade with one of said side contact blades during said sub-interval; and, (e) cycling one of the side contact blades of said single-pole double-throw switch with said program cam for making and breaking contact with said center blade.

7. The method defined in claim 6, further comprising providing a single-pole single-throw switch having a pair of contact blades and moving one contact blade of said pair with said program cam and moving the other contact blade of said pair with said sub-interval cam.

8. The method defined in claim 7, wherein said step of moving said other contact blade of said pair includes providing a first and second cam track on said sub-interval cam and moving said other contact blade of said pair with said second cam track.

* * * * *